US005261570A

United States Patent [19]

Hippely et al.

[11] Patent Number: 5,261,570

[45] Date of Patent: Nov. 16, 1993

[54] FLEXIBLE LIQUID DISPENSER

[76] Inventors: Keith A. Hippely, 514 Harkness St., Manhattan Beach, Calif. 90266; Jon L. Stern, 470 S. Bedford Dr., #401, Beverly Hills, Calif. 90212

[21] Appl. No.: 689,320

[22] Filed: Apr. 22, 1991

[51] Int. Cl.[5] ..... B65D 37/00

[52] U.S. Cl. ..... 222/212; 222/549; 222/175; 206/235; 224/148; 63/1.1

[58] Field of Search ..... 222/23, 548, 549, 555, 222/39, 78, 175, 206, 212; 239/53-56, 36; 206/37, 823, 235; 224/148, 160, 214; 63/1.1, 2; 40/219, 312; 359/846-848

[56] References Cited

U.S. PATENT DOCUMENTS

| | | | |
|---|---|---|---|
| 1,472,350 | 10/1923 | Albanese . | |
| 2,235,350 | 3/1941 | Anderson | 224/28 |
| 2,687,133 | 8/1954 | Schwarz | 206/235 X |
| 2,770,771 | 11/1956 | Baranowski | 222/23 X |
| 3,231,155 | 1/1966 | McConnell | 222/549 X |
| 3,270,525 | 9/1966 | Sellers | 239/36 X |
| 3,412,907 | 11/1968 | Faso | 222/187 |
| 3,640,274 | 2/1972 | Costello | 222/527 X |
| 4,023,712 | 5/1977 | Babiak et al. | 222/175 |
| 4,477,002 | 10/1984 | Stoll | 222/549 X |
| 4,488,668 | 12/1984 | Flaska et al. | 222/548 |
| 4,690,304 | 9/1987 | Morel | 222/520 X |
| 4,736,876 | 4/1988 | Kriss | 224/148 |
| 4,741,459 | 5/1988 | Silvenis et al. | 222/23 |
| 4,768,688 | 9/1988 | Harrigan | 222/175 X |
| 4,891,956 | 1/1990 | MacDonald | 63/2 X |
| 4,903,860 | 2/1990 | Leopoldi et al. | 222/175 X |
| 4,932,566 | 6/1990 | Weinbaum | 222/175 |
| 5,037,005 | 8/1991 | Appleby et al. | 222/215 X |
| 5,044,530 | 9/1991 | Stull | 222/549 X |
| 5,058,637 | 10/1991 | Fell | 222/23 X |
| 5,102,010 | 4/1992 | Osgar et al. | 222/105 X |

OTHER PUBLICATIONS

Elmer's Glue All ® Cap.

*Primary Examiner*—Andres Kashnikow
*Assistant Examiner*—Kenneth DeRosa
*Attorney, Agent, or Firm*—Lyon & Lyon

[57] ABSTRACT

A flexible liquid dispenser which may be used to hold and discharge suntan lotion, sunscreen lotion, perfume, insect repellent, or other liquids. In one embodiment the liquid dispenser is relatively flat, about 0.5 inch thick, fits in the palm of a person's hand, and may be conveniently carried in a person's pocket or hung around a person's neck by a cord or tube attached to the dispenser. The dispenser body may be made out of molded plastic and has at least one flexible wall portion which allows the dispenser body to be compressed for the purpose of discharging the liquid from the dispenser. The liquid dispenser has a rotatable cap which may be turned to open a dispensing aperture in the cap. Liquid may then be discharged through the dispensing aperture by squeezing or compressing the dispenser body. The shape of the cap matches the outer contour of the dispenser body when the cap is unturned, providing a smooth outer surface for the dispenser that will not damage or rip a person's pocket, and will be comfortable to carry. The liquid dispenser has a mirror, or reflective surface, and advertising label attached to the outside of the dispenser. The cap may be removed for the purpose of refilling the dispenser.

5 Claims, 2 Drawing Sheets

FLEXIBLE LIQUID DISPENSER

CROSS-REFERENCE TO RELATED APPLICATION

The subject matter of this application is related to the subject matter of our design application, filed concurrently herewith, entitled "LIQUID CONTAINER."

BACKGROUND OF THE INVENTION

The present invention relates generally to liquid or lotion dispensers and, more particularly, to a flexible liquid dispenser which may be used to hold and discharge suntan lotion, sunscreen lotion, perfume, insect repellent, or other liquids. The flexible liquid dispenser is relatively flat and has at least one flexible portion which will compress to force liquid through an opening in a cap rotatably engaged to the dispenser.

In the past, a variety of different containers have been designed for the purpose of dispensing different liquids or lotions. For example, U.S. Pat. No. 3,412,907, issued to Faso on Nov. 26, 1968, discloses a perfume container and sprayer which may be squeezed for the purpose of discharging a perfume through an opening at the bottom of the container. Liquid dispensers wearable as bracelets and having at least one hollow portion capable of holding a liquid or liquid are described in U.S. Pat. Nos. 4,736,876, issued to Kriss on Apr. 12, 1988; 4,768,688, issued to Harrigan on Sep. 6, 1988; and 2,235,350, issued to Anderson on Mar. 18, 1941. Finally, U.S. Pat. No. 1,472,350, issued to Albanese on Oct. 30, 1923, discloses a pendant watch having a built-in mirror on a hinged door member and a hollow portion for holding a powder puff.

Rotating caps have been used in the past to discharge liquid from containers. The caps are usually attached to necks of the containers. Cords have also been used to hang a container around a person's neck.

SUMMARY OF THE INVENTION

Problems are often encountered in carrying containers such as a liquid dispenser. The containers are often large and bulky, making it difficult to place such containers in a person's pocket. Furthermore, the necks or caps of such containers often are pointed or have shapes that may be uncomfortable in a person's pocket. In addition, many containers have rigid sidewalls, or are unflexible, making it difficult to discharge thick liquids from the containers. Other containers have easily removable caps which may be misplaced, lost or accidently opened when not in use.

Some containers, like a woman's compact, have a reflective surface, such as a mirror, attached inside the compact. However, there is a need to attach a reflective surface or mirror to an exterior portion of a cosmetic or liquid container where it may be used to visually aid a person in applying a lotion or other liquid discharged from the container. Accordingly, there is a need for a new improved liquid dispenser.

It is an object of this invention to provide a relatively flat flexible liquid dispenser that may be conveniently carried in the pocket of a person, or hung from a person's neck.

It is another object of this invention to provide a flexible liquid dispenser having a smooth outer surface that will not damage or rip a person's pocket.

It is still another object of this invention to provide a flexible liquid dispenser having a mirror or reflective surface attached to it.

It is still another object of this invention to provide a flexible liquid dispenser having a cap which will not accidently detach or separate from the dispenser in the ordinary course of usage.

It is still another object of this invention to provide a flexible liquid dispenser which can be refilled by a user.

It is still another object of this invention to provide a flexible liquid dispenser with a neck cord or tube which detaches from the dispenser when moderate force is applied.

It is still another object of this invention to provide a flexible liquid dispenser that is easy to use and economical to manufacture.

These and other objects and advantages are attained by a flexible liquid dispenser which may be used to hold and discharge suntan lotion, sunscreen lotion, perfume, insect repellent, or other liquids. In one embodiment, the liquid dispenser is flat, about 0.5 inch thick, fits in the palm of a person's hand, and may be conveniently carried in a person's pocket or hung around a person's neck by a cord or tube attached to the dispenser. The dispenser body may be made out of molded plastic and has at least one flexible wall portion which may be compressed or flexed for the purpose of discharging the liquid from the dispenser. For example, the dispenser may have rigid front and rear walls which may be compressed together by having at least one flexible sidewall. The liquid dispenser has a rotatable cap which may be turned to open a dispensing aperture in the cap. Liquid may then be discharged through the dispensing aperture.

The shape of the cap matches the outer contour of the dispenser body when the cap is unopened, providing a smooth outer surface for the dispenser which will not damage a person's pocket and which will be comfortable to carry or to hold. The liquid dispenser also has a mirror, or reflective surface, and an advertising label attached to the outside of the dispenser.

The various features of the present invention will be best understood together with further objects and advantages by reference to the following description of the preferred embodiments taken in conjunction with the accompanying drawings.

DESCRIPTION OF THE PREFERRED EMBODIMENT

The following specification taken in conjunction with the drawings sets forth the preferred embodiments of the present invention in such a manner that any person skilled in the art can make and use the invention. The embodiments of the invention disclosed herein are the best modes contemplated by the inventors for carrying out their invention in a commercial environment although it should be understood that various modifications can be accomplished within the parameters of the present invention.

Figure 1:
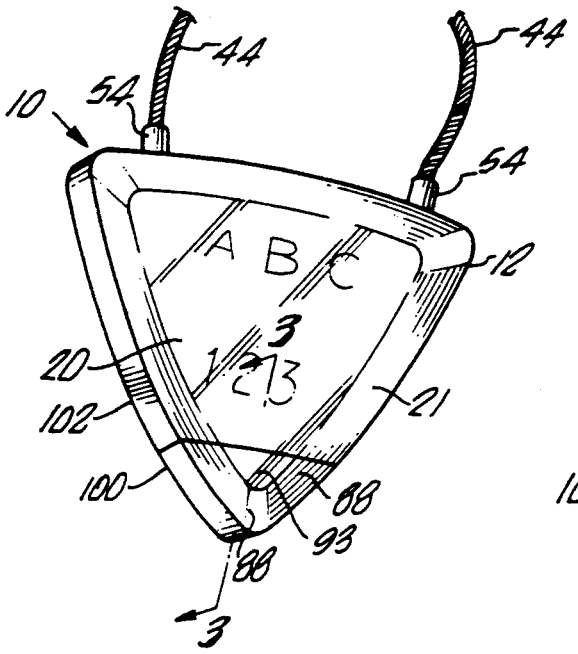
FIG. 1 is a perspective view of a flexible liquid dispenser illustrating the principles of the present invention.
Figure 2:
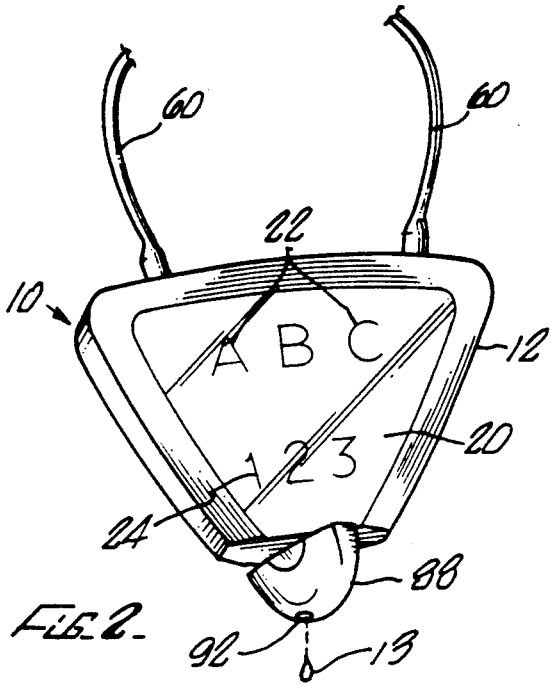
FIG. 2 is a perspective view of the flexible liquid dispenser showing how a cap may be rotated in order to discharge liquid from the dispenser.

FIGS. 1 and 2 show a preferred embodiment of a flexible liquid dispenser 10 of the present invention. The liquid dispenser 10 preferably has a generally triangular shape and is relatively flat and thin (see FIG. 6). Preferably, the dispenser 10 is about 0.5 inch thick, and the thickness of the dispenser preferably has a range of from about 0.4 inch to about 0.6 inch. As a result, the liquid dispenser 10 may be conveniently slipped into a pocket or under a shirt when worn around a user's neck as discussed below.

The essentially triangular shape makes the liquid dispenser 10 more attractive than a conventional round bottle, and provides a shape that fits in a person's palm and may be easily gripped. When a triangular shape is used for the dispenser 10, each side of the triangular shape is preferably about 2⅝ inches, and preferably has a range of from about 2 inches to about 3 inches in order to provide a palm-size dispenser 10. It is important to point out that any desirable shape or size may be used for the dispenser 10, and a larger or smaller version of the dispenser 10 may be used, if desired.

The dispenser 10 has a hollow, thin-shelled, relatively flat body portion 12 that is preferably blow-molded or injection molded out of plastic, or made out of any suitable material. The body portion 12 has a wall thickness 14 (see FIG. 3) that varies in size depending upon what material is used for portion 12 and in order to provide a desired flexibility which allows a person to squeeze the dispenser 10 to discharge liquid 13 from the dispenser 10 as discussed below.

The dispenser 10 has at least one flexible wall portion thereof, either front, rear or side(s), which is used to help discharge liquid 13 therefrom. For example, only the front wall 17 or rear wall 19 of the dispenser 10 needs to be flexible in order to discharge liquid 13 (see FIG. 6). Alternatively, only one of the sidewalls 23 needs to be flexible for discharging liquid 13. However, both sidewalls 23, and/or both the front and rear walls 17 and 19 may be flexible, if desired.

Figure 4:
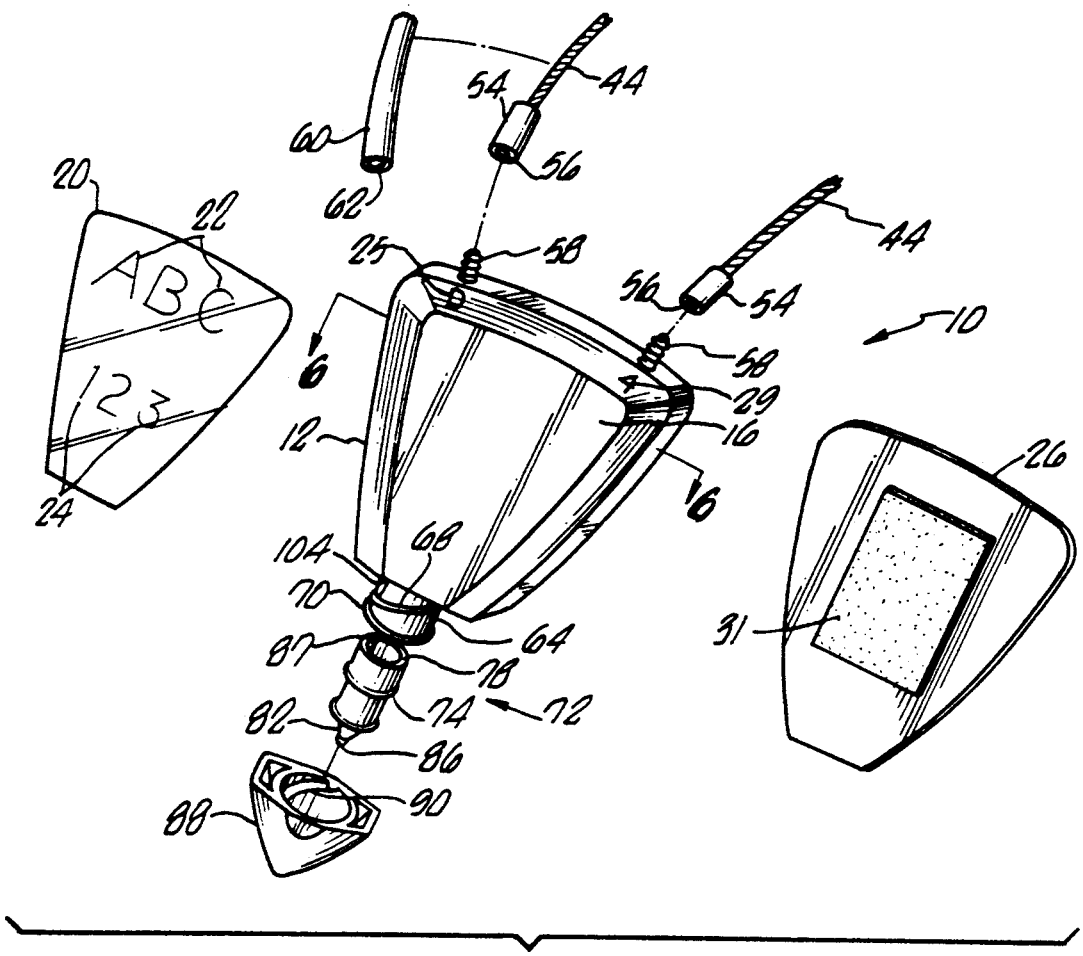
FIG. 4 is an exploded perspective view of the flexible liquid dispenser.
Figure 6:
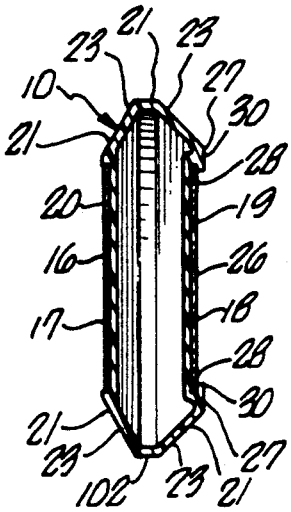
FIG. 6 is a cross-sectional view taken in the direction of arrows 6—6 shown in FIG. 4.

The dispenser 10 preferably has recessed areas 16 and 18 in the front and rear walls 17 and 19 thereof as best shown in FIG. 6. A label 20, as shown in FIG. 4, is preferably attached to, or mounted in, recessed area 16 by adhesive, two-sided adhesive tape, or the like. The label 20 preferably has indicia 22 and 24 thereon for providing desirable information such as information about the liquid 13 inside the dispenser 10. The label 20 may also be an advertising label having advertising indicia 22 and 24 thereon. The label 20 is preferably made out of metallized foil and may have prismatic or holographic embossing thereon. However, the label 20 may be made out of paper or any other suitable material. Alternatively, the body portion 12 may also have indicia 25 and 29 (see FIG. 4) thereon, if desired.

A mirror, or reflective surface 26, is preferably attached to, or mounted in, recessed area 18. The mirror 26 allows a user to see his or her face. As such, a user may look at his or her face in the mirror 26 to see if liquid or lotion 13 such as suntan or sunscreen lotion needs to be applied, or to assist in applying such lotion or insect repellent, or to examine his or her face after lotion or repellent has been applied.

The mirror 26 is preferably made of an acrylic plastic material, cut to fit the shape of recessed area 18 (preferably triangular-shaped), and relatively flush with border area 27 surrounding area 18 (see FIG. 6) in order to provide a smooth outside surface for the dispenser 10. The mirror 26 may be attached by adhesive, hot melt glue, sonic welding, two-sided adhesive tape 31 (see FIG. 4), or the like, and any mirror-like or reflective surface may be used as a substitute for the acrylic plastic mirror 26.

Alternatively, undercut areas 28 with holding portions 30 may be used to mount the mirror 26 in recessed area 18 as shown in FIG. 6. However, any suitable means may be used for mounting or attaching the mirror 26 to recessed area 18, and the label 20 to recessed area 16. In addition, the liquid dispenser 10 may have labels 20 attached to both recessed areas 16 and 18, or mirrors 26 attached to both areas 16 and 18.

Figure 5:
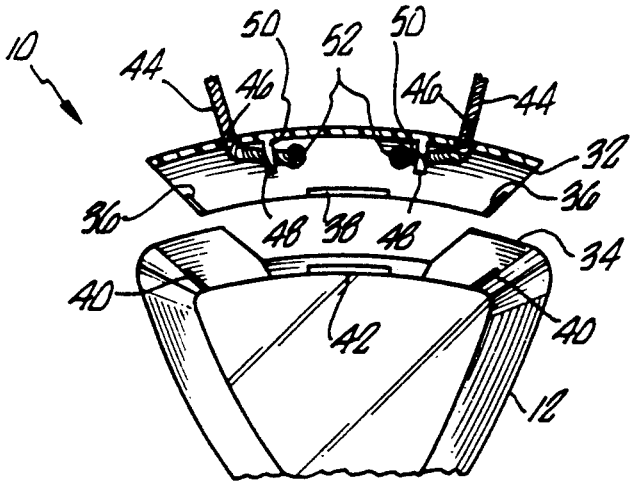
FIG. 5 is a cross-sectional view of another embodiment of the flexible liquid dispenser showing an upper portion of the dispenser with a top portion thereof that may be disengaged or removed from the dispenser.

Another embodiment of the liquid dispenser 10 is shown in FIG. 5 which has a top portion 32 releasably engaged to a top 34 of the dispenser 10. The top portion 32 is releasably or removably engaged to the top 34 of the dispenser 10 by engaging portions 36 and 38 on top portion 32, which releasably engage engaging portions 40 and 42 on top 34. As a result, top portion 32 may be easily removed from the liquid dispenser 10 and, for example, replaced with another top portion 32 to adapt the dispenser 10 from a product hanging around a user's neck to a smaller product without a cord 44 (discussed below) which fits easily inside the user's pocket or purse. Top portion 32 may be reengaged to the dispenser 10 by snapping or forcing together portions 36, 38, 40, and 42. Any desirable means may be used to engage top portion 32 to top 34. For example, pin and socket connections (not shown), or the like, may be used.

The cord 44 is made out of cotton, nylon, polyester, vinyl, rubber, or the like, and is attached to top portion 32 of the dispenser 10. The cord 44 may be used to conveniently hang the liquid dispenser 10 around a user's neck. As shown in FIG. 5, the cord 44 may be attached to top portion 32 or dispenser 10 by passing the cord 44 through apertures 46 in portion 32 and apertures 48 in webs 50, and then heat sealing ends 52 of the cord 44. Alternatively, adhesive may be applied to the ends 52 of the cord 44 to keep the cord 44 attached to portion 32.

The cord 44 may also be attached to dispenser 10 by end members 54 attached to the ends 52 of the cord 44, for example, by adhesive, or by heat sealing ends 52 so that ends 52 will not disengage from internal bores 56 in members 54. The end members 54 are then attached to ribbed pins 58 which are part of or may be attached to the dispenser 10 (see FIG. 4). The end members 54 may be attached by using adhesive, by forcing the pins 58 into the bores 56, or by using both methods of attachment.

A flexible tube 60 may be used instead of the cord 44. The tube 60 may be made out of any material such as plastic, vinyl, rubber, nylon, or the like, and attached to the dispenser 10 by forcing pins 58 into internal bore 62 of the tube 60. Adhesive may also be used to attach the tube 60 to the ribbed pins 58. If adhesive is not used to attach the tube 60 or cord 44 to the ribbed pins 58, then the tube 60 or the cord 44 will easily disengage from the ribbed pins 58 and separate from the dispenser 10 when pulled with moderate force.

Figure 3:
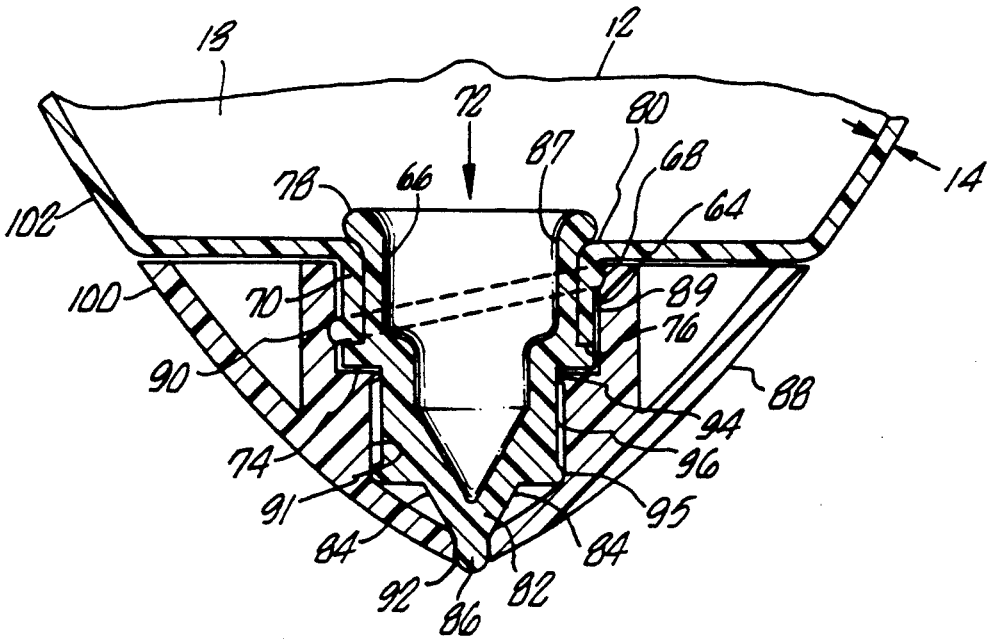
FIG. 3 is a partial cross-sectional view taken in the direction of arrows 3—3 shown in FIG. 1.

The plastic body portion 12 has a downwardly extending cylindrical portion or throate 64 with an internal bore 66 and a diagonal ridge 68 at the outside surface 70 thereof. As shown in FIG. 3, a plunger insert 72 is fit into bore 66 of cylindrical portion 64 so that flange 74 of insert 72 abuts against end 76 of portion 64 and top annular lip 78 of insert 72 contacts inner ridge 80 of portion 64. The plunger insert 72 has internal bores 85 and 87, a downwardly extending conical portion 82 with apertures 84 therein, and a tip 86 at the bottom thereof. As such, insert 72 is adapted to channel liquid 13 down internal bores 85 and 87 and through apertures 84 for the purpose of discharging the liquid 13 from the dispenser 10.

A cap 88 is rotatably engaged to cylindrical portion 64 of the dispenser 10 and around the plunger insert 72. The cap 88 has internal bores 89 and 91 therein, a diagonal groove 90 at bore 89, and a dispensing aperture 92 at the bottom thereof. When the dispenser 10 is assembled, diagonal ridge 68 engages groove 90 so that cap 88 rotates about insert 72.

As shown in FIG. 3, tip 86 of insert 72 engages dispensing aperture 92 when the cap 88 is oriented as shown in FIG. 1, keeping the liquid 13, which passes through apertures 84, from being discharged from the dispenser 10 through aperture 92. However, when the cap 88 is rotated, for example, a half-turn as shown in FIG. 2, the cap 88 moves downward due to the engagement of ridge 68 with groove 90, thereby causing tip 86 to disengage aperture 92. Downward movement of the cap 88 is guided by annular guide 94 extending inward from internal bore 91 which contacts outside surface 96 of insert 72 and by bottom annular lip 95 that engages bore 91.

In order to provide a smooth outside surface for the dispenser 10, the cap 88 is shaped to match the outer contour of the body portion 12 adjacent the cap 88. As shown in FIGS. 1 and 3, outer surface 100 of the cap 88 is shaped to be relatively flush with or to match an outer peripheral contour 102 of the sidewalls 23 of body portion 12 when the cap 88 is in an unturned or unopened position as shown in FIG. 1. In addition, outer surfaces 98 of cap 88 (at the front and rear of the cap 88 when the cap is oriented as shown in FIG. 1) are shaped to be relatively flush with or to match adjacent border areas 21 of the front and rear walls 17 and 19 of the body portion 12 when the cap 88 remains unturned or unopened (see FIG. 6). Finally, front and rear outer surfaces 93 of cap 88 (when oriented as shown in FIG. 1) are also shaped to be flush with or to match recessed areas 16 and 18, or the label 20 and mirror 26. As such, the shape of the cap 88 matches the outer contour of the liquid dispenser 10 when the cap 88 is unturned or unopened, providing a relatively smooth outer surface for the dispenser 10 that will not damage a person's pocket, and will be comfortable to carry or hold.

When the cap 88 is turned or opened as shown in FIG. 2, its surfaces 93, 98 and 100 are no longer flush with contour 102, border areas 21, recessed areas 16 and 18, or the label 20 and mirror 26 (see FIGS. 1 and 6). As such, the cap 88, when turned, provides a visual and tactile indication that it is turned, or aperture 92 is open, making it unlikely that an open dispenser 10 will be put in a user's pocket, or hung around a person's neck. In addition, the cap 88 will not separate from the dispenser 10 during normal usage, thereby precluding the cap 88 from being lost or misplaced.

FIGS. 1–6 show a generally triangular-shaped liquid dispenser 10. However, any desired shape may be used for the dispenser 10. For example, the dispenser 10 may have a circular or rectangular shape, with the cap 88 shaped to match such geometric shapes, thus providing a smooth outer surface for the dispenser 10.

A user may force liquid 13 through apertures 84 and 92 by turning cap 88 as shown in FIG. 2, thereby causing tip 86 to disengage from dispensing aperture 92, and squeezing or compressing the flexible body portion 12 to cause liquid 13 to be discharged through aperture 92. After the liquid 13 is discharged, it may then be applied to the user's face while looking at the mirror 26.

As disclosed above, liquid 13 may be discharged from the dispenser 10 when cap 88 is turned as shown in FIG. 2 causing aperture 92 to open. If the cap 88 is then further turned in the same direction with moderate additional force past a stop 104 in diagonal ridge 68 of cylindrical portion 64 (see FIG. 4), the cap 88 will detach or separate from the dispenser 10. This will provide a user access to apertures 84 (see FIG. 3) through which the dispenser 10 can be refilled with liquid 13. For example, a specially fitted refill nozzle or a separate refill container may be snapped onto plunger insert 72 and liquid 13 may be pumped into dispenser 10 through apertures 84.

Any type of liquid or lotion 13 may be used, such as suntan lotion, sunscreen lotion, perfume, insect repellent, or the like. The design of the cap 88 and insert 72 provides a self-cleaning action which prevents dispensing aperture 92 from becoming clogged by the liquid 13 after repeated uses of the dispenser 10. In other words, tip 86 of insert 72 with a piston-like action engages and disengages aperture 92 with each use, preventing clogging of aperture 92.

The mirror 26 may be used to periodically check whether a person's face is being sunburned, or tanned properly. A person may also use the mirror 26 to evenly apply suntan or sunscreen lotion to his or her face, or to apply makeup, or the like.

The above description discloses the preferred embodiment of the present invention. However, persons of ordinary skill in the art are capable of numerous modifications once taught these principles. By way of example and not limitation, a bladder containing liquid 13 may be placed inside the body portion 12 and the flexible wall portion of the body portion 12 may be squeezed to discharge liquid 13 from the dispenser 10. In addition, cap 88 may be hinged to body portion 12 and contoured to be flush with adjacent surfaces of the body portion when snapped shut. Accordingly, it will be understood by those skilled in the art that changes in form and details may be made to the above-described embodiment without departing from the spirit and scope of the invention.

We claim:

1. A liquid dispenser for holding and discharging liquid, comprising:

a substantially planar hollow body portion with flexible front and rear walls and being adapted to hold liquid, said flexible front and rear walls having at least one flexible wall portion adapted so that said body portion can be compressed in order to discharge liquid from said dispenser;

a non rigid reflective surface attached to and covering a portion of the entire outside surface of one of said front and rear walls; and said hollow body portion having a throat portion leading to a selectively sealable opening for dispensing liquid from said hollow body through the throat to the exterior;

wherein at least one of said flexible walls has a recessed area which is provided with undercuts for receiving and attaching the non rigid reflective surface thereto.

2. A liquid dispenser for holding and discharging liquid, comprising:

a thin-walled, hollow, substantially planar body portion adapted to hold liquid, said flexible front and rear walls and at least one of said flexible front and rear walls having a portion adapted so that said body portion can be compressed in order to discharge liquid from said dispenser;

a substantially flat, non-rigid mirror means mounted on one of said front and rear walls; and a cap engaged to said body portion, said body portion and said cap providing a substantially smooth outer surface for said dispenser, said cap having an aperture through which said liquid is discharged;

wherein at least one of said flexible walls has a recessed area which is provided with undercuts for receiving and attaching the non rigid mirror-like surface thereto.

3. A liquid dispenser for holding and discharging liquid, comprising:

a thin-walled, hollow, substantially planar body portion adapted to hold liquid, said body portion having flexible front and rear walls and at least one of said flexible front and rear walls having a flexible wall portion adapted so that said body portion can be compressed in order to discharge liquid from said dispenser;

a non rigid mirror surface attached to at least one of said walls, and a cap rotatably engaged to said body portion, said cap having outer surfaces that are (1) substantially flush with adjacent outer surfaces of said body portion when said cap is in an unturned first position so that a substantially smooth outer surface is provided for said dispenser, and (2) not flush with said adjacent outer surfaces of said body portion when said cap is turned to a second position, said cap having an aperture through which said liquid is discharged;

wherein at least one of said flexible walls has a recessed area which is provided with undercuts for receiving and attaching the non rigid mirror surface thereto.

4. A liquid dispenser for holding and discharging liquid, comprising:

a thin-walled hollow substantially planar body portion adapted to hold liquid, said body portion having flexible front, rear and side walls, and being adapted to discharge liquid from said dispenser, a flexible mirror surface attached to at least one of said walls of the body portion;

a cap engaged to said body portion having outer surfaces that are (1) substantially flush with adjacent outer surfaces of said body portion when said cap is in an unopened first position so that a substantially smooth outer surface is provided for said dispenser, and (2) not flush with said adjacent outer surface of said body portion when said cap is opened to a second position, said cap having an aperture through which said liquid is discharged;

wherein at least one of said flexible walls has a recessed area which is provided with undercuts for receiving and attaching the flexible mirror surface thereto.

5. A liquid dispenser for holding and discharging liquid, comprising:

a substantially planar hollow body portion with flexible front and rear walls and being adapted to hold liquid, said flexible front and rear walls having at least one flexible wall portion adapted so that said body portion can be compressed in order to discharge liquid from said dispenser;

a non rigid reflective surface attached to and covering a portion of the outside surface of one of said front and rear walls;

said hollow body portion having a throat portion leading to a selectively sealable opening for dispensing liquid from said hollow body through the throat to the exterior;

a cord attached to said hollow body portion;

wherein ribbed pins are attached to said substantially planar hollow body portion and said cord has annular end members attached thereto which are forced over the ribbed pins to removably attach the dispenser to the cord.

* * * * *